US006940457B2

(12) United States Patent
Lee et al.

(10) Patent No.: US 6,940,457 B2
(45) Date of Patent: Sep. 6, 2005

(54) MULTIFREQUENCY ANTENNA WITH REDUCED REAR RADIATION AND RECEPTION

(75) Inventors: Yoonjae Lee, Fairfax, VA (US); Suman Ganguly, Fairfax, VA (US); Raj Mittra, State College, PA (US)

(73) Assignee: Center for Remote Sensing, Inc., Fairfax, VA (US)

( * ) Notice: Subject to any disclaimer, the term of this patent is extended or adjusted under 35 U.S.C. 154(b) by 59 days.

(21) Appl. No.: 10/657,824

(22) Filed: Sep. 9, 2003

(65) Prior Publication Data

US 2005/0052321 A1 Mar. 10, 2005

(51) Int. Cl.[7] ..... H01Q 1/38
(52) U.S. Cl. ..... 343/700 MS; 343/840
(58) Field of Search ..... 343/700 MS, 872, 343/840

(56) References Cited

U.S. PATENT DOCUMENTS

| | | | | |
|---|---|---|---|---|
| 4,827,271 A | | 5/1989 | Berneking et al. | |
| 4,847,625 A | | 7/1989 | Dietrich et al. | |
| 5,025,264 A | | 6/1991 | Stafford | |
| 5,241,321 A | | 8/1993 | Tsao | |
| 5,448,250 A | | 9/1995 | Day | |
| 5,635,942 A | | 6/1997 | Kushihi et al. | |
| 5,861,848 A | | 1/1999 | Iwasaki | |
| 5,945,950 A | | 8/1999 | Elbadawy | |
| 6,054,953 A | | 4/2000 | Lindmark | |
| 6,100,855 A | | 8/2000 | Vinson et al. | |
| 6,191,740 B1 | * | 2/2001 | Kates et al. | 343/700 MS |
| 6,208,309 B1 | | 3/2001 | Chandler et al. | |
| 6,278,407 B1 | * | 8/2001 | Ashjaee et al. | 343/700 MS |
| 6,326,923 B2 | | 12/2001 | Shigihara | |
| 6,445,354 B1 | | 9/2002 | Kunysz | |
| 6,452,560 B2 | | 9/2002 | Kunysz | |
| 6,480,170 B1 | | 11/2002 | Langley et al. | |
| 6,492,947 B2 | * | 12/2002 | Anderson | 343/700 MS |
| 6,549,167 B1 | | 4/2003 | Yoon | |
| 6,552,685 B2 | * | 4/2003 | Zhang | 343/700 MS |
| 6,606,061 B2 | | 8/2003 | Wong et al. | |
| 2002/0080072 A1 | * | 6/2002 | Zhang | 343/700 MS |
| 2003/0103006 A1 | * | 6/2003 | Yamada | 343/700 MS |
| 2004/0036645 A1 | * | 2/2004 | Fujieda et al. | 342/70 |

OTHER PUBLICATIONS

Proceeding of ION Sep. 2003.*

Filippov, V. et al., "The First Dual–Depth Dual–Frequency Choke Ring," Proceedings of ION, Sep. 1998.

Gao, S. et al, "A Broad–Band Dual–Polarized Microstrip Patch Antenna With Aperture Coupling," IEEE Transactions on Antenna Propagation, vol. 51, No. 4, Apr. 2003, pp. 898–900.

(Continued)

*Primary Examiner*—Shih-Chao Chen
*Assistant Examiner*—Hung Tran Vy
(74) *Attorney, Agent, or Firm*—David Newman Chrtd.

(57) ABSTRACT

A multifrequency antenna comprising a stack of nonconductive substantially planar substrates, with a conductive layer disposed on each substrate surface. A first substrate includes transmission lines disposed on a rear surface and a conducting layer on the other surface. A second substrate is stacked on the first substrate. A conducting layer is disposed on one side of the second substrate surface. Conducting layers disposed on first and second substrates include a plurality of slotted openings arrayed about an antenna axis. A third substrate stacked on the second substrate includes a conducting layer top. A lossy dielectric-magnetic material encloses sides and rear of the multifrequency antenna, to prevent electromagnetic energy penetration through the enclosure. An edge diffraction suppresser reflector is attached in the rear surface of the multifrequency antenna, and has two or more essentially circular, conducting plates and a multitude of conducting cylinders along the axis of the multifrequency antenna.

25 Claims, 10 Drawing Sheets

OTHER PUBLICATIONS

Klefenz, F. et al, "Aperture–coupled stacked microstrip antenna with dual polarization and low back–radiation for X–band SAR applications," Radio and Wireless Conference, 2000. RAWCON 2000, Sep. 2000, pp. 179–182.

Lo, Y. T. et al., "Theory and Experiment on Microstrip Antennas," IEEE Transactions on Antennas and Propagation, vol. 27, No. 2, Mar. 1979, pp. 137–145.

Lee Y. et al., "Multiband L5 Capable GPS Antenna," Proceedings of ION, Sep. 2003.

Pozar, M. et al. , "A Dual–Band Circularly Polarized Aperture–Coupled Stacked Microstrip Antenna for Global Positioning Satellite," IEEE Transactions on Antennas and Propagation, vol. 45, No. 11, Nov. 1997, pp. 1618–1625.

Targonski, S. D. et al., "An aperture coupled stacked patch antenna with 50% bandwidth," Antennas and Propagation Society International Symposium, 1996. AP–S. Digest, Jul. 1996, pp. 18–21.

Targonski, S. D. et al., "Design of Wide–Band Aperture–Stacked Patch Microstrip Antennas," IEEE Transactions on Antennas and Propagation, vol., 46, No. 9, Sep. 1998, pp. 1245–1251.

Targonski, S. D. et al., "Wideband aperture coupled microstrip patch array with backlobe reduction," Electronics Letters, vol. 33, No. 24, Nov. 1997, pp. 2005–2006.

Wang, J. et al., "Multifunctional Aperture Coupled Stacked Antenna," Antennas and Propagation Society International Symposium, 1991. AP–S. Digest, Jun. 24–28, 1991, pp. 727–730.

* cited by examiner

MULTIFREQUENCY ANTENNA WITH REDUCED REAR RADIATION AND RECEPTION

BACKGROUND OF THE INVENTION

This invention relates to multifrequency antennas, and more particularly to a multifrequency antenna with reduced rear radiation and reception, for use in the frequency band of Global Positioning Systems (GPS).

DESCRIPTION OF THE RELEVANT ART

A multifrequency operation is quite demanding in various applications, for instance, in Global Positioning Systems (GPS), $L_1$ (1575.42 MHz) and $L_2$ (1276.4 MHz) signals. Two GPS signals currently are used to compensate for propagation effects from the ionosphere. The future GPS will use additional $L_5$ (1176.45 MHz) band as well.

Recently, several GPS antenna designs with improved multipath rejection capabilities and reduced sizes for high precision survey have appeared. There are drawbacks, however, such as large ground plane size, high vertical profile, insufficient front-to-back (F/B) ratio and pattern roll-off.

Multipath is a limiting factor in precision GPS applications. Multipath signals arrive with arbitrary incident angles to the antenna depending upon the environment around the antenna. The multipath signals from below horizon due to the reflections from the ground and mounting structure are main concerns because the antenna usually is mounted less than two meters above the ground and it is difficult for the signal processing in the receiver to mitigate the effect of short distance multipath, less than 10 meters. In this case, the multipath signals can be suppressed by tailoring the receiving pattern of the antenna. The ideal GPS antenna would have a uniform gain for the upper hemisphere and blocks the signal coming from below the horizon.

The conventional-choke ring ground plane consists of several concentric thin metallic rings around the antenna element and the bottom of the conventional-choke ring is connected to a thick conducting circular disk. If the height of the conventional-choke ring, a metal or conducting wall, were chosen to be close to quarter wavelength of the operating frequency, then the top end of the conventional-choke rings effectively can be an open circuit, in which the wave propagation to the direction of horizon is suppressed. Because the ring depth is determined by the operating frequency, the conventional choke ring has optimum effect only on the particular frequency. Recently, an attempt was made to realize a dual frequency choke ring, M. Zhodzishsky, M. Vorobiev, A. Khvalkov, J. Ashjaee, "The First Dual-Depth Dual-Frequency Choke Ring," Proc. Of ION GPS-98, pp. 1035–1040, 1998, in which a special diaphragm, slot filter, is used inside the choke ring groove that blocks the high frequency but passes lower frequencies. The special diaphragm works as a slot filter. The depth of the groove may be different for two frequencies. One of the drawbacks of the conventional-choke ring is fairly large footprints, typically 15 inches, limiting use of the conventional-choke ring in portable applications.

Realization of a reduced size antenna with comparable performances to the standard choke ring antenna, also capable of multifrequency operation, is particularly demanding.

SUMMARY OF THE INVENTION

A general object of the invention is an antenna that can transmit and receive a circularly polarized signal at multitude of frequencies with extended bandwidth at each operating band, in our case, three GPS bands, L1, L2 and L5.

Another object of the invention is high performance in terms of bandwidth, enough bandwidth to cover the GPS bandwidth 20 MHz and future extension 24 MHz, axial ratio, cross-polarization rejection level, greater than −20 dB, and multipath interference mitigation capability, backlobe suppression.

A further object of the invention is an antenna that has a hemispherical coverage above the horizon and minimal transmission and reception levels for the lower hemisphere.

An additional object of the invention is a new method for constructing an edge diffraction suppressor, choke ring, for multifrequency with reduced size.

A still further object of the invention is an appropriate consideration for the polarization of the multipath signals.

According to the present invention, as embodied and broadly described herein, a multifrequency antenna is provided, comprising a plurality of nonconducting substantially planar substrates, a lossy-dielectric-magnetic material, and an edge-diffraction reflector. Each planar substrate of the plurality of nonconducting substantially planar substrates, has a conductive layer disposed on a surface. A first substrate of the plurality of nonconducting substantially planar substrates, has a transmission line disposed on a rear surface, and has a first conducting layer disposed on a other surface. The first conducting layer includes a plurality of slotted openings arrayed about an antenna axis.

A second substrate of the plurality of nonconducting substantially planar substrates, is stacked on the first substrate. The second substrate has a second conducting layer disposed on a surface. The second conducting layer includes a multiplicity of slotted openings arrayed about an antenna axis.

A third substrate of the plurality of nonconducting substantially planar substrates, is stacked on the second substrate. The third substrate has a third conducting layer disposed on a surface.

The lossy-dielectric-magnetic material encloses sides and rear of the multifrequency antenna. The lossy-dielectric-magnetic material prevents electromagnetic energy penetration through the rear and sides of the multifrequency antenna. Thus, the multifrequency antenna thereby radiates and receives electromagnetic energy from a front of the multifrequency antenna.

The edge-diffraction reflector is attached to the rear of the multifrequency antenna. The edge-diffraction reflector includes at least two essentially circular, conducting plates. The edge-diffraction reflector has a plurality of conducting cylinders, each with height essentially shorter than a diameter along an axis of the multifrequency antenna.

Additional objects and advantages of the invention are set forth in part in the description which follows, and in part are obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention, and together with the description serve to explain the principles of the invention.

DETAILED DESCRIPTION OF THE PREFERRED EMBODIMENTS

Figure 1:
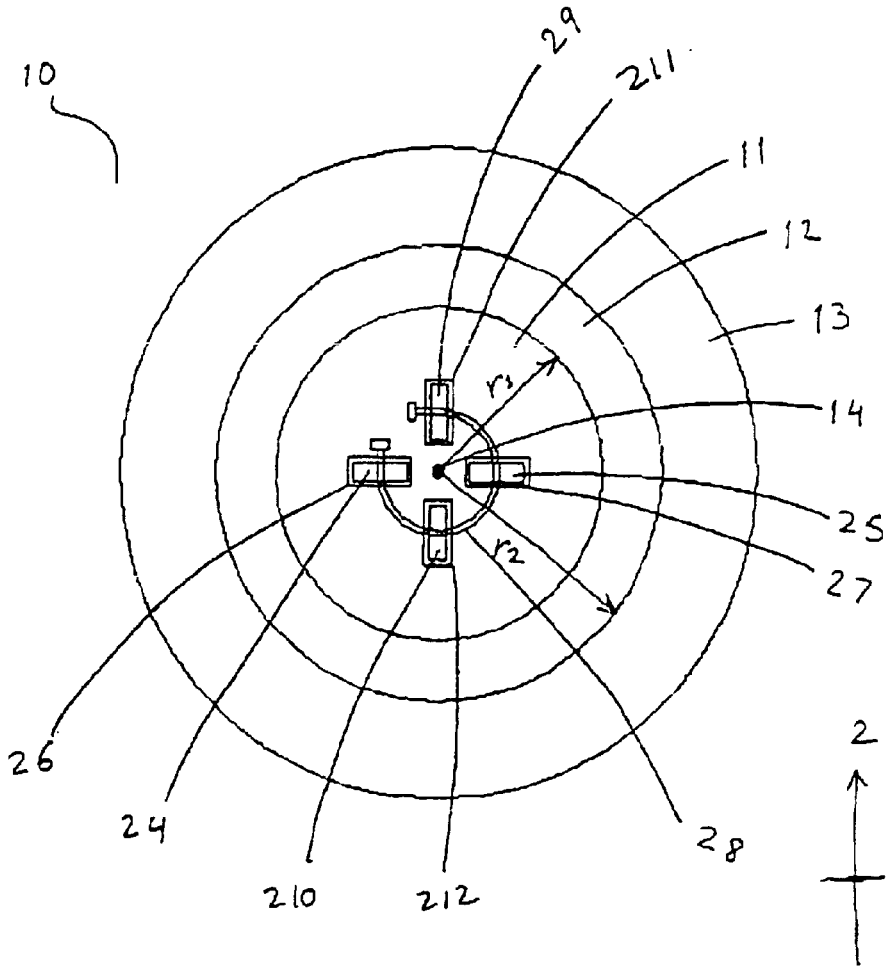
FIG. 1 is a diagrammatical view of the front surface of an aperture-coupled multifrequency antenna in accordance with the present invention.

Reference now is made in detail to the present preferred embodiments of the invention, examples of which are illustrated in the accompanying drawings, wherein like reference numerals indicate like elements throughout the several views.

A novel approach is provided for an antenna for Global Positioning Systems. The present invention has a new type of choke ring which provides comparable performances with conventional-choke rings, but with reduced size. The new choke ring also is capable of operating at multiple frequencies, such as GPS $L_1$ (1575.42 MHz) and $L_2$ (1276.4 MHz) bands. The new choke ring also can operate at future GPS bands, as a tri-band GPS antenna, by way of example, $L_1$, $L_2$, and $L_5$ (1176.45 MHz)

As a tri-band GPS antenna, the present invention allows multiple patch antenna configuration, slot coupling both in the ground plane and patch, and design parameters for optimum performance. The design parameters include slot locations and dimensions, with slot dimensions in the patch chosen smaller than that of the slots in the ground plane. The present invention also considers polarization issues for the backside multipath.

The present invention includes a multifrequency antenna for receiving and transmitting circularly polarized electromagnetic signals. The multifrequency antenna comprises a plurality of nonconducting substantially planar substrates, a lossy-dielectric-magnetic material, and an edge-diffraction reflector. Each planar substrate of the plurality of nonconducting substantially planar substrates, has a conductive layer disposed on a surface. A planer substrate might have, by way of example, the planar substrate embodied as a printed circuit board, with the conductive layer embodied as a metallic layer on one side. The present invention is taught, by way of example, for three substrates with three conducting layers, respectively. The present invention may be extended to more layers of substrates with respective conducting layers.

Figure 2:
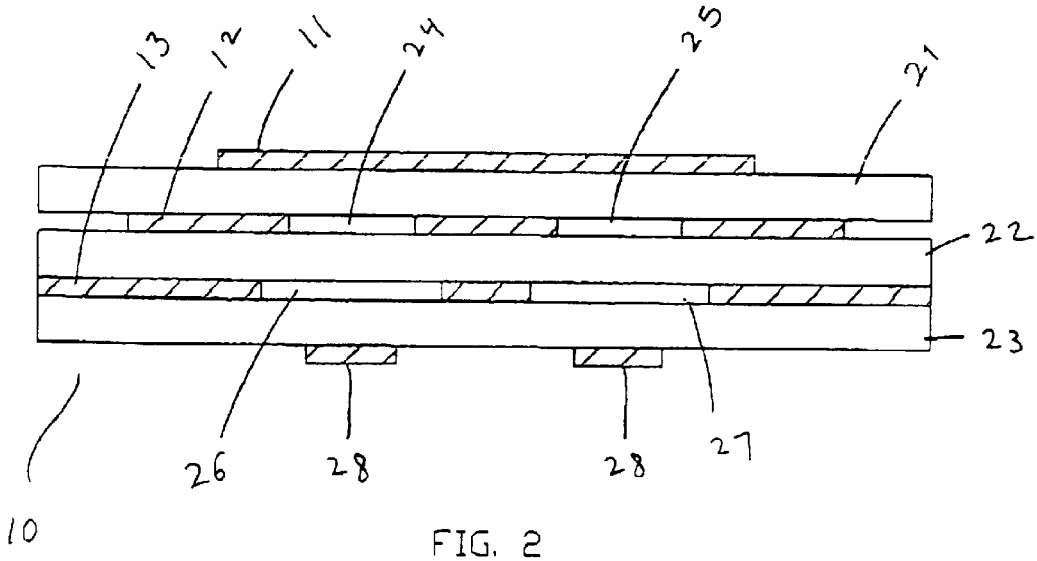
FIG. 2 is a cross sectional view of the antenna of FIG. 1.

As illustratively shown in FIGS. 1 and 2, a first substrate 23 of the plurality of nonconducting substantially planar substrates, has a transmission line 28 disposed on a rear surface, and has a first conducting layer 13 disposed on a other surface. The first conducting layer 13 includes a plurality of slotted openings 26, 27, 211, 212 arrayed about an antenna axis 14. The first conducting layer 13 includes a co-axially located circular patch 13.

A second substrate 22 of the plurality of nonconducting substantially planar substrates, as shown in FIG. 2, is stacked on the first substrate 23. The second substrate 22 has a second conducting layer 12 disposed on a surface. The second conducting layer 12 includes a second multiplicity of slotted openings 24, 25, 29, 210 arrayed about the antenna axis 14. The second multiplicity of slotted openings 24, 25, 29, 210 of FIGS. 1 and 2, preferably is located above the first multiplicity of slotted openings 26, 27, 211, 212, respectively. The second conducting layer 12 includes a co-axially located circular patch 12. The second conducting layer 12 typically has a different radius from the first conducting layer 13.

A third substrate 21 of FIGS. 1 and 2 of the plurality of nonconducting substantially planar substrates, is stacked above the second substrate 22, as shown in FIG. 2. The third substrate 21 has a third conducting layer 11 disposed on a surface. The third substrate 21 is referred to herein as the front side of the multifrequency antenna 10, of FIGS. 1 and 2.

The third conducting layer 11 typically has a different radius from the second conducting layer 12, and from the first conducting layer 13. Typically the size of the third conducting layer 11 is less than the size of the second conducting layer 12; and the size of the third conducting layer 11 and the size of the second conducting layer 12 are less than the size of the first conducting layer 13. In a preferred embodiment, where each conducting layer is circular in shape, the radius of the third conducting layer 11 is less than the radius of the second conducting layer 12; and, the radius of the third conducting layer 11 and the radius of the second conducting layer 12 are less than the radius of the first conducting layer 13. Other shapes for each conducting layer may be used, including by way of example and without limitation, square, rectangular, oval, triangular, pentagon, hexagon, octagon, as well as other well-known planar shapes.

The radii for each conducting layer, embodied as a circular patch, is determined from the wavelengths, or frequencies, to be used by the multifrequency antenna. The frequencies are determined from formulas derived from a cavity model by Y. T. Lo, D. Solomon, W. F. Richards, "Theory and Experiment on Mircrostrip Antennas," *IEEE Trans. Antennas Propagat.,* Vol. AP-27, No. 2, pp. 137–145, March 1979. and, Resonant frequencies for the $TM^z_{mn0}$ of the circular patch antenna, L. Shen, S. Long, M. Allerding, M. Walton, "Resonant frequency of a circular disc, printed-circuit antenna," *IEEE Trans. Antennas Propagat.,* Vol. AP-25, No. 4, pp. 595–596, July 1977, are found to be $$(f_r)_{mn0} = \frac{1}{2\pi\sqrt{\mu\varepsilon}}\left(\frac{\chi'_{mn}}{a}\right) \tag{1}$$

where $\mu$ is the permeability of the substrate and $\in$ is the dielectric constant of the substrate, $\chi'_{mn}$ is the zeros of the derivative of the Bessel function $J_m(\chi)$ and a is the radius of the circular patch. The patch radius for the dominant mode at frequency f is given by $$a = \frac{1.8412\,cv_0}{2\pi f\sqrt{\varepsilon_r}} \tag{2}$$

where c is speed of light, $v_0$ is velocity factor of the substrate, and $\in_r$ is the dielectric constant of the substrate. A permeability of 1.0 and a dielectric constant of 2.2 widely are used for commonly available substrate material, such as printed circuit board. The resonant frequency $f_r$ of equation (2) does not take into account a fringe effect which makes the patch look electrically larger. This may be corrected by using a correction factor, with the resulting relation given below:

$$a_e = a\left\{1 + \frac{2h}{\pi a\varepsilon_r}\left\{\ln\left(\frac{\pi a}{2h}\right) + 1.7726\right\}\right\}^{\frac{1}{2}} \tag{3}$$

where h is substrate height, which is typically very small ($h<0.05\ \lambda$)

The dimensions of the patches are further adjusted for optimal performance. Referring to FIGS. 1 and 2, the patches 11, 12 include the plurality of slotted openings embodied as a plurality of rectangular slots 24, 25, 26, 27, 29, 210, 211, 212. The plurality of rectangular slots 24, 25, 26, 27, 29, 210, 211, 212 are arrayed around the antenna axis 14. The multifrequency antenna includes two stacked circular patches 11, 12. The lower circular patch 12 is excited through four apertures 26, 27, 211, 212 in the ground plane 13. The upper circular patch, 11 are excited through four apertures 26, 27, 211, and 212 in the ground plane 13 and four apertures 24, 25, 29, and 210 in the lower circular patch 12.

The top patch 11 resonates at the $L_1$ band (1575.42 MHz) and the bottom patch 12 resonates at the center of $L_2$ (1227.6 MHz) and $L_5$ (1176.45 MHz) band. Since the aperture coupled stacked patch antenna has wider impedance matching characteristic and axial ratio bandwidth, the two lower bands ($L_2$ and $L_5$) are covered with a single bottom patch 12 with the aid of stacked $L_1$ top patch 11 as a parasitic element at lower frequency bands. The patches are coupled through slots to the feeding microstrip lines 28 in the backside of the bottom substrate 23. The feed line 28 is a leaky microstrip line designed to be matched to 50-Ω output impedance. 90-degree phase offset has been achieved using quarter-wave stripline.

Figure 3:
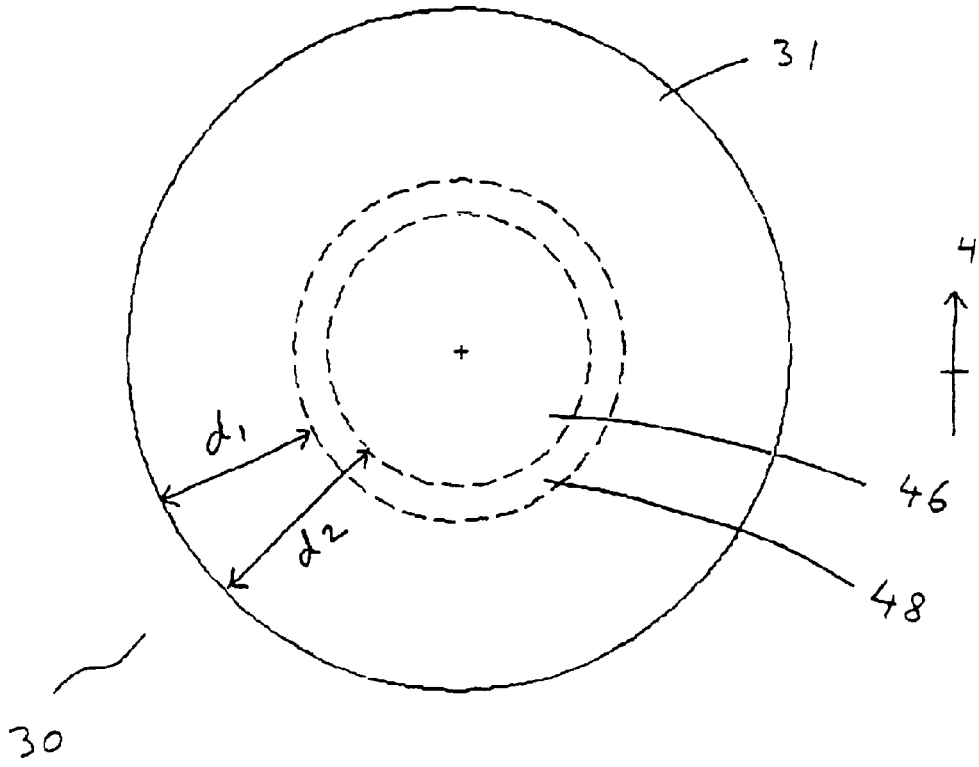
FIG. 3 is a diagrammatical view of an edge diffraction suppression structure located on the rear of the antenna of FIG. 1.
Figure 4:
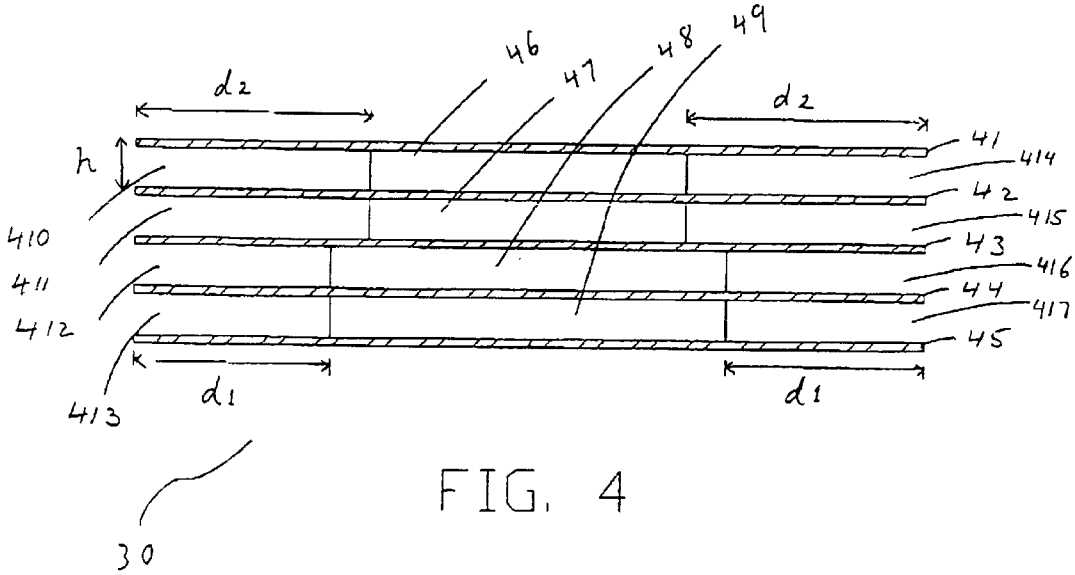
FIG 4 is a cross sectional view of the edge diffraction suppression structure of FIG. 3.

In the exemplary arrangement shown in FIG. 3, a diagrammatical view is shown of an edge-diffraction reflector 30, which is located on the rear of the multifrequency antenna 10 of FIG. 1. FIG. 4 is a cross sectional view of the edge-diffraction reflector 30 of FIG. 3. The edge-diffraction reflector 30 is attached to the rear of the multifrequency antenna 10. The edge-diffraction reflector 30 includes at least two essentially circular, conducting plates. The edge-diffraction reflector typically has a plurality of conducting plates 41, 42, 43, 44, 45, each with height essentially shorter than a diameter along an axis of the multifrequency antenna.

In a preferred embodiment, each conducting plate of the plurality of conducting plates 41, 42, 43, 44, 45 has a circular shape. Other shapes for each conducting plate of the plurality of the conducting plates 41, 42, 43, 44, 45 may be used, including by way of example and without limitation, square, rectangular, oval, triangular, pentagon, hexagon, octagon, as well as other well-known planar shapes. Typically, the shape of each conducting plate in the plurality of conducting plates 41, 42, 43, 44, 45 is the same shape as each conducting layer on each planar substrate of the plurality of nonconducting substantially planar substrates.

The edge-diffraction reflector 30 of the present invention is a new design concept in view of the conventional-choke ring. With the edge-diffraction reflector 30 the overall size compared to a conventional-choke ring, has been greatly reduced. The edge-diffraction reflector 30 still maintains the capabilities of suppressing the back lobe and enhancing the pattern roll-off characteristic comparable to the conventional-choke ring. The edge-diffraction reflector of the present invention uses the plurality of conducting plates 41, 42, 43, 44, 45, preferably circular in shape, instead of using ring type walls as with the conventional-choke ring. The grooves 410, 411, 412, 413, 414, 415, 416, 417 are constructed by adjacent plates and center cylinders. The plurality of conducting plates 41, 42, 43, 44, 45 and conducting center cylinders 46, 47, 48, 49 can be vertically stacked to increase suppression.

The depths d1, d2 of the grooves are determined by wavelength of the intended frequencies, which in the preferred embodiment, are the GPS frequencies. The concept has been investigated by numerical simulations using a finite element method (FEM) based electromagnetic solver, named HFSS. The antenna element chosen for the simulation is a cavity backed cross dipole resonating at 1.1 GHz and the new vertical choke ring consists of five stacked grooves, which are attached to the bottom of the cavity. The diameter of the cavity and vertical choke ring is 180 mm and the overall height of the vertical choke ring is 50 mm, which are much smaller dimensions compared to those of the conventional-choke rings. The groove depth has been varied to find an optimum choice. The Front/Back ratio vs. groove depth is shown in Table 1. The optimum depth has been found to be 0.18 λ for the given configuration, which is somewhat less than the quarterwave length of the operating frequency. Our research shows that the optimum depth varies depending upon the diameter of the choke ring and the separation distance of the circular plates.

TABLE 1

| RADIUS OF THE PEC PLATES (mm) | DEPTH (mm) | DEPTH (WAVE-LENGTH AT 1.1 GHz) | FRONT/BACK RATIO (dB) |
|---|---|---|---|
| ANTENNA ONLY | ANTENNA ONLY | ANTENNA ONLY | 16 |
| 90 | 68.25 | 0.25 | 21 |
| 90 | 65 | 0.24 | 22 |
| 90 | 60 | 0.22 | 20 |
| 90 | 55 | 0.20 | 23 |
| 90 | 50 | 0.18 | 27.5 |
| 90 | 45 | 0.165 | 24 |

Figure 5:
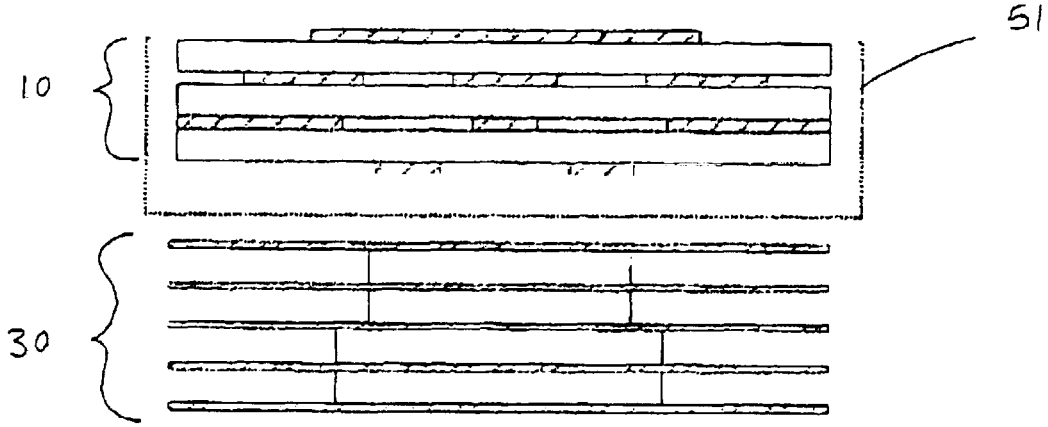
FIG. 5 is a cross sectional view of a complete antenna system of the present invention.

As illustratively shown in FIG. 5, lossy-dielectric-magnetic material 51 may enclose sides and rear of the multifrequency antenna 10. The lossy-dielectric-magnetic material 51 prevents electromagnetic energy penetration through the rear and sides of the multifrequency antenna 10. Thus, the multifrequency antenna 10 thereby radiates and receives electromagnetic energy from a front of the multifrequency antenna 10.

More particularly, FIG. 5 shows a cross sectional view of a complete multifrequency antenna system of the present invention. In order to prevent unwanted radiation from the feeding network, the rear and side of the antenna are encapsulated by using the lossy-dielectric material 51, which may be embodied as microwave absorbing material. The edge-diffraction reflector 30 typically is located outside the lossy-dielectric material 51.

Figure 6:
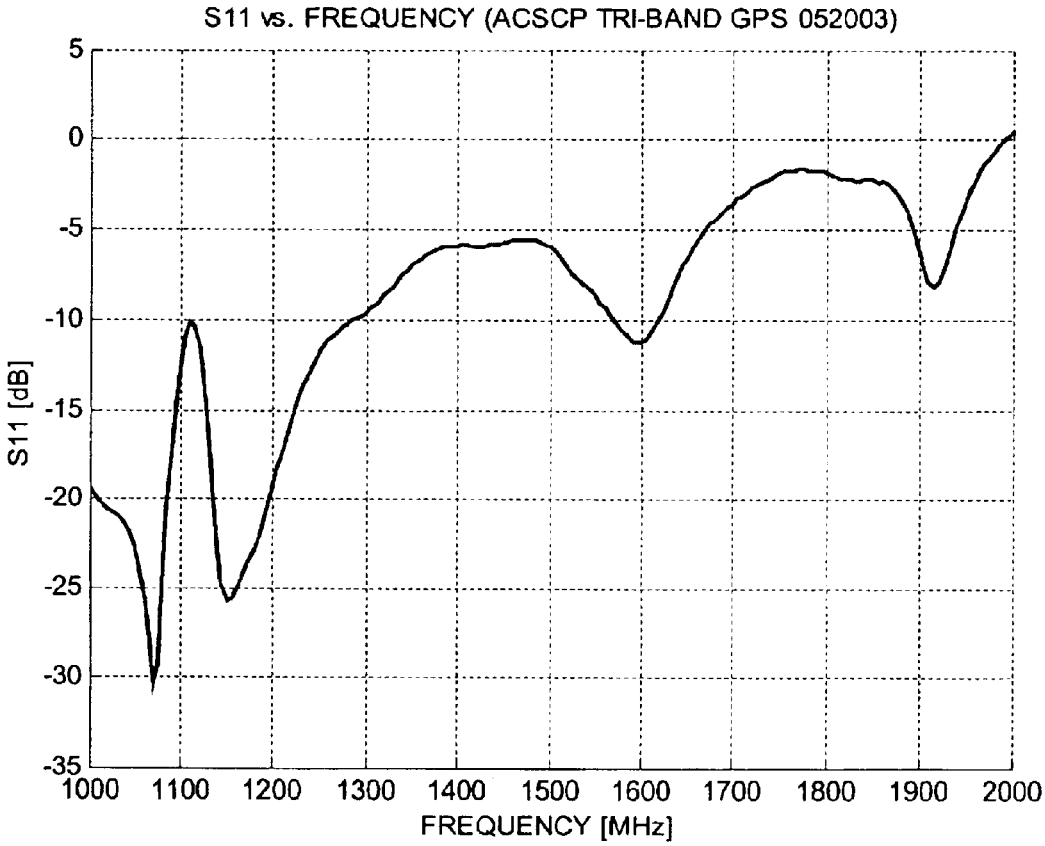
FIG. 6 is a diagram showing measured return loss of the present invention shown in FIG. 1 through FIG. 4.

FIG. 6 is a diagram showing measured return loss of the present invention shown in FIG. 5. As shown in the plot, the designed antenna has very wide matching characteristics over the GPS bands.

Figure 7:
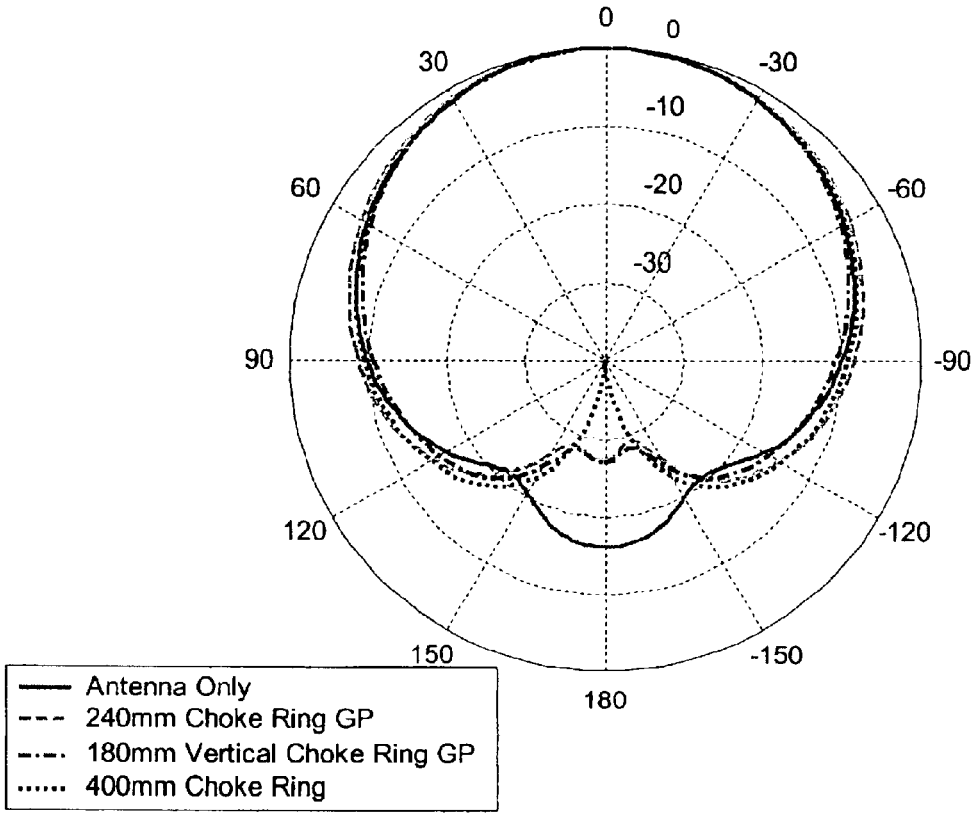
FIG. 7 is a diagram showing simulated antenna gain pattern comparison for different choke ring configurations.

FIG. 7 is a diagram showing simulated antenna gain pattern comparison for different choke ring configurations. In FIG. 7, the total field patterns, right-hand-circular polarization and left-hand-circular polarization (RHCP+LHCP) are compared for antenna only, 400 mm standard conventional-choke ring, 240 mm conventional-choke ring, and 180 mm vertical choke ring, edge-diffraction reflector of the present invention. We can see from FIG. 7 that the 180 mm vertical choke ring suppresses the back lobe level by approximately 10 dB, which is the same performance of the 240 mm conventional-choke ring ground plane.

Figure 8:
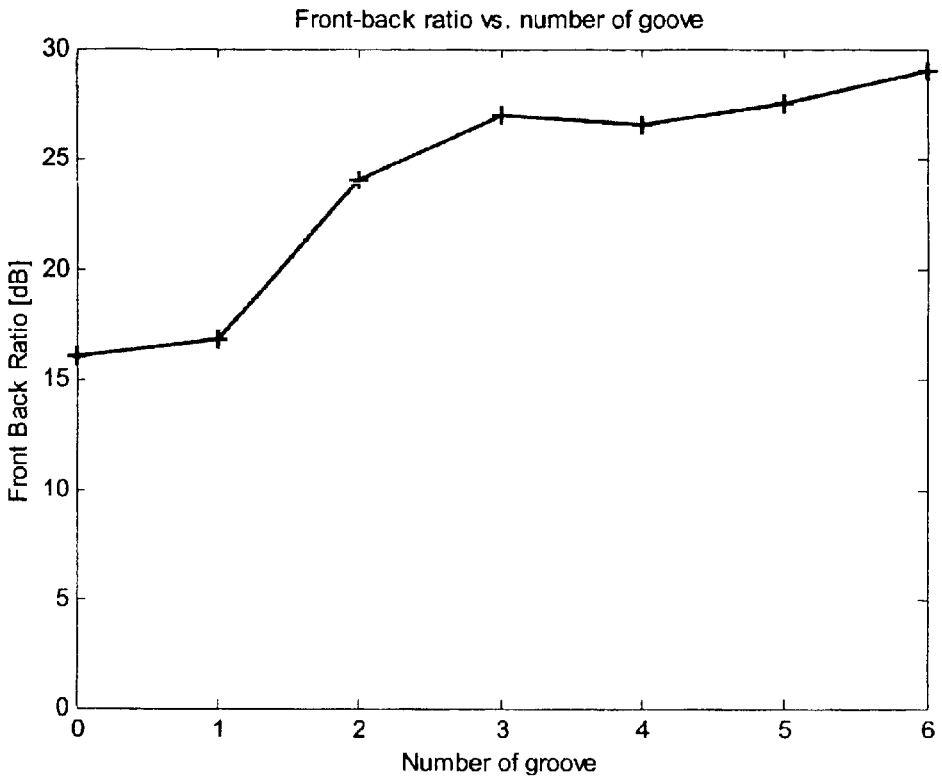
FIG. 8 is a diagram showing simulated Front/Back ratio as a function of number of grooves associated with the edge diffraction suppressed reflector shown in FIG. 3 and FIG. 4 of the present invention.

FIG. 8 is a diagram showing simulated Front/Back ratio as a function of number of grooves associated with the edge diffraction reflector shown in FIG. 3 and FIG. 4 of the present invention. The number of groove varied from 0 to 6 and the corresponding F/B ratios have been plotted in FIG. 8. It is observed that the enhancement of F/B ratio is most noticeable up to three grooves and after that, the degree of enhancement decreases.

Figure 9:
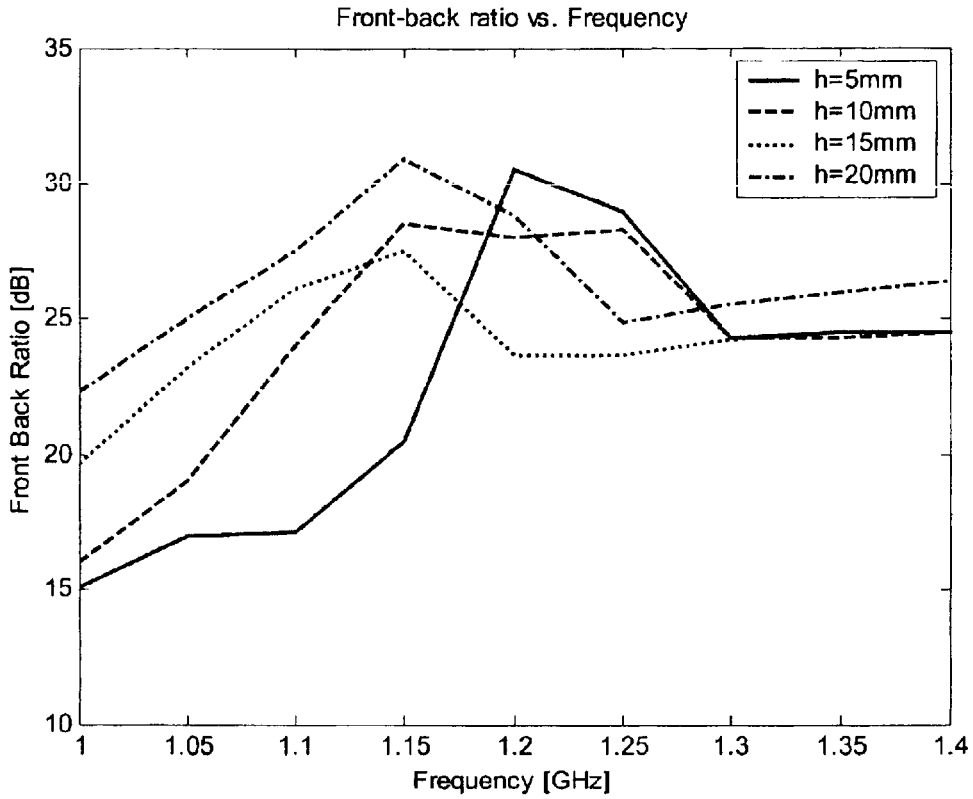
FIG. 9 is a diagram showing the comparison of the simulated Front/Back ratio as a function of frequency for the different groove width associated with the edge diffraction suppressed reflector shown in FIG. 3 and FIG. 4 of the present invention.

FIG. 9 is a diagram showing the comparison of the simulated Front/Back ratio as a function of frequency for the different groove width associated with the edge diffraction reflector shown in FIG. 3 and FIG. 4 of the present invention. FIG. 9 shows the effect of groove width. As shown in FIG. 9, a wider groove has suppression effect over a wider frequency range. We also note that the suppression levels rapidly fall off toward the lower frequency than upper frequency.

Figure 10:
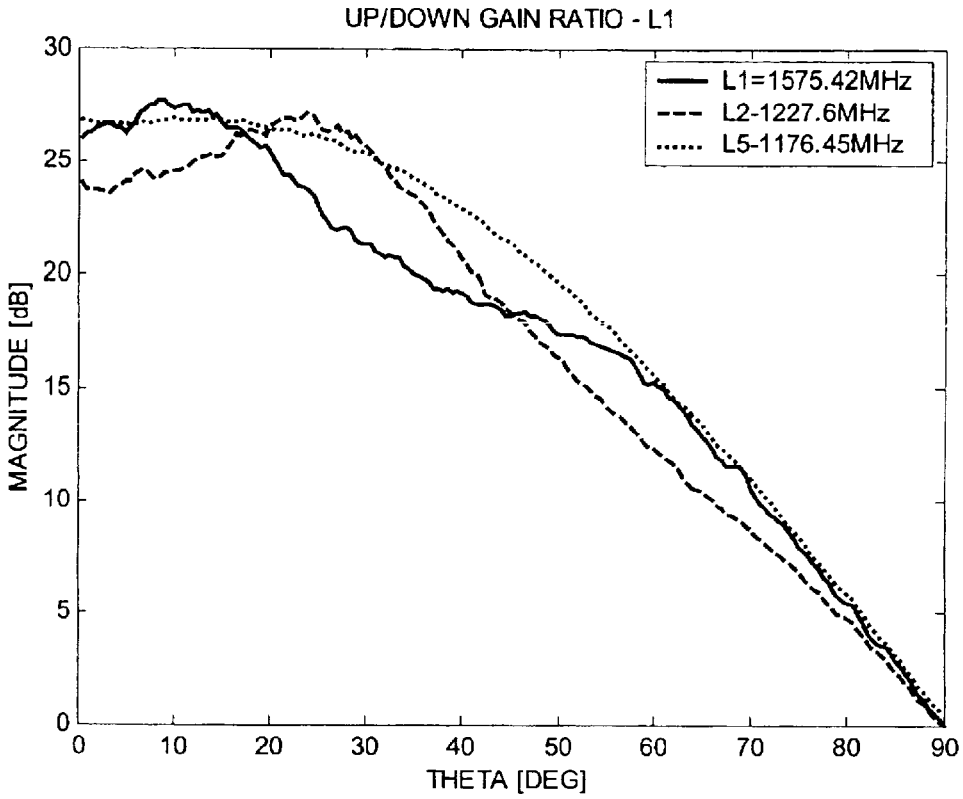
FIG. 10 is a diagram showing measured Up/Down gain ratio of the present invention shown in FIG. 1 trough FIG. 4.

FIG. 10 is a diagram showing measured Up/Down gain ratio of the present invention shown in FIG. 5. The antenna exhibits very desirable performances over the GPS bands.

The summary of design procedure for the aperture-coupled stacked patch antenna is as follows.

The design parameters to be determined are patch sizes, aperture dimensions/location and substrate properties, height, dielectric constant, and etc., associated with the layouts shown in FIG. 1. The first step of the design is to determine the patch sizes r1 and r2 for each band. When the substrate height, t, is very small ($t<<0.05\ \lambda$), the resonant frequency of the microstrip antenna is approximated by the cavity model. We use thick low permittivity substrate for the patch to obtain the maximum bandwidth.

The effect of the slot dimensions to the antenna is dependent to the antenna geometry, in general. Larger slot length introduces the higher coupling between the patch and feed line, but that also shifts the resonant frequencies and increases the unwanted back radiation. The location of the slot affects the resonant frequency, cross-pol pattern and the impedance matching between the feed line and patches. It is evident that determining the parameters one by one is impossible for large number of strongly coupled parameters. For this type of design, the design strategy would be to reduce the number of design parameters by pre-selecting some fixed design choices and optimize the initial design using the numerical modeling tools. The initial patch sizes are determined by (3) and the bottom substrate height and dielectric constant is chosen after finding the slot locations and dimensions because there are some design flexibilities for the feed lines depending upon how to choose the substrate parameters. The slots in the aperture-coupled antenna are considered as a series reactance between the patch and feed line and that effect can be eliminated by placing additional open circuited stub after the slot. Once the slot parameters are chosen, then the feed line is designed for circular polarization. There are four 90 degree rotated slots each incorporated in the ground plane and lower patch. At lower band, the most of the energy is coupled to the lower patch and the upper patch is parasitically coupled to the lower patch, which provides required additional bandwidth for the lower band and at upper band, the lower patch is more tightly coupled to the ground plane, so the lower patch effectively acts like a ground plane to the upper patch.

The initial slot dimensions and locations have been found for the single slot, single feed, linearly polarized circular patch antenna and the effect of the variation has been studied, then applied to the circularly polarized antenna. The feed line is a leaky microstrip line designed to be matched to 50-Ω output impedance. 90-degree phase offset has been achieved using quarterwave stripline. An important design goal is that the feed line 28 must maintain minimal phase error and impedance variations over the entire band, for instance, $L_5$ through $L_1$. We design the feed line for the center frequency, 1.4 GHz, of the three bands and use a relatively high permittivity substrate to restrain the impedance variations and phase errors introduced by changes of the electrical length of the feed line as the operating frequency has offset to the center frequency since the required correction for the physical dimensions of the feed lines on the high permittivity substrate is less than that is required for the low permittivity substrate for the same frequency offset. The final design has been obtained by iterating the above steps within a fixed range of variation for the each parameter.

It will be apparent to those skilled in the art that various modifications can be made to the multifrequency antenna with reduced rear radiation and reception of the instant invention without departing from the scope or spirit of the invention, and it is intended that the present invention cover modifications and variations of the multifrequency antenna provided they come within the scope of the appended claims and their equivalents.

What is claimed is:

1. A multifrequency antenna comprising:

a plurality of nonconducting substantially planar substrates, with a conductive layer disposed on a surface of each planar substrate of the plurality of nonconducting substantially planar substrates;

a first substrate of the plurality of nonconducting substantially planar substrates, having a transmission line disposed on a rear surface of the first substrate, and having a first conducting layer disposed on a other surface of the first substrate, with the first conducting layer including a plurality of slotted openings arrayed about an antenna axis;

a second substrate of the plurality of nonconducting substantially planar substrates, stacked on the first substrate, and having a second conducting layer disposed on a surface of the second substrate, with the second conducting layer including a multiplicity of slotted openings arrayed about an antenna axis;

a third substrate of the plurality of nonconducting substantially planar substrates, stacked on the second substrate, and having a third conducting layer disposed on a surface of the third substrate;

a lossy-dielectric-magnetic material for enclosing sides and rear of the multifrequency antenna, for preventing electromagnetic energy penetration through the rear and sides of the multifrequency antenna, with the multifrequency antenna thereby radiating and receiving electromagnetic energy from a front of the multifrequency antenna; and an edge-diffraction reflector attached to rear of the multifrequency antenna, including at least two conducting plates and a plurality of conducting cylinders with height essentially shorter than a diameter along an axis of the multifrequency antenna.

2. The multifrequency antenna as set forth in claim 1, with the at least two conducting plates having an essentially circular shape.

3. The multifrequency antenna as set forth in claim 1, with the plurality of nonconducting substantially planar substrates, with the conductive layer disposed on the surface of each planar substrate of the plurality of nonconducting substantially planar substrates, including a printed circuit board having a metallic surface on one side.

4. The multifrequency antenna as set forth in claim 1, with the first substrate of the plurality of nonconducting substantially planar substrates, having the first conducting layer including the plurality of slotted openings arrayed about then antenna axis including at least four slotted openings spaced about the antenna axis at ninety degrees.

5. The multifrequency antenna as set forth in claim 4, with the second substrate of the plurality of nonconducting substantially planar substrates, having the second conducting layer including the plurality of slotted openings arrayed about then antenna axis including at least four slotted openings spaced about the antenna axis at ninety degrees.

6. The multifrequency antenna as set forth in claim 1, with the each conductive layer on each of the plurality of nonconducting substantially planar substrates, having a circular shape.

7. The multifrequency antenna as set forth in claim 1, with the each conductive layer on each of the plurality of nonconducting substantially planar substrates, having any of a square, rectangular, oval, triangular, pentagon, hexagon, or octagon shape.

8. The multifrequency antenna as set forth in claim 1, with the edge-diffraction reflector attached to rear of the multifrequency antenna, including at least five conducting plates.

9. The multifrequency antenna as set forth in claim 1, with the each conducting plate having a circular shape.

10. The multifrequency antenna as set forth in claim 1, with the each conducting plate having any of a square, rectangular, oval, triangular, pentagon, hexagon, or octagon shape.

11. An improvement to a multifrequency antenna comprising:

a lossy-dielectric-magnetic material for enclosing sides and rear of the multifrequency antenna, for preventing electromagnetic energy penetration through the rear and sides of the multifrequency antenna, with the multifrequency antenna thereby radiating and receiving electromagnetic energy from a front of the multifrequency antenna; and an edge-diffraction reflector attached to rear of the multifrequency antenna, including at least two conducting plates and a plurality of conducting cylinders with height essentially shorter than a diameter along an axis of the multifrequency antenna.

12. The multifrequency antenna as set forth in claim 11, with the edge-diffraction reflector attached to rear of the multifrequency antenna, including at least five conducting plates.

13. The multifrequency antenna as set forth in claim 11, with the each conducting plate having a circular shape.

14. The multifrequency antenna as set forth in claim 11, with the each conducting plate having any of a square, rectangular, oval, triangular, pentagon, hexagon, or octagon shape.

15. A multifrequency antenna comprising:

a plurality of nonconducting substantially planar substrates, with a conductive layer disposed on a surface of each planar substrate of the plurality of nonconducting substantially planar substrates;

a first substrate of the plurality of nonconducting substantially planar substrates, having a transmission line disposed on a rear surface of the first substrate, and having a first conducting layer disposed on a other surface of the first substrate, with the first conducting layer including a plurality of slotted openings arrayed about an antenna axis;

a second substrate of the plurality of nonconducting substantially planar substrates, stacked on the first substrate, and having a second conducting layer disposed on a surface of the second substrate, with the second conducting layer including a multiplicity of slotted openings arrayed about an antenna axis;

a third substrate of the plurality of nonconducting substantially planar substrates, stacked on the second substrate, and having a third conducting layer disposed on a surface of the third substrate, and a lossy-dielectric-magnetic material for enclosing sides and rear of the multifrequency antenna, for preventing electromagnetic energy penetration through the rear and sides of the multifrequency antenna, with the multifrequency antenna thereby radiating and receiving electromagnetic energy from a front of the multifrequency antenna.

16. The multifrequency antenna as set forth in claim 15 further including an edge-diffraction reflector attached to rear of the multifrequency antenna, including at least two essentially circular, conducting plates and a plurality of conducting cylinders with height essentially shorter than a diameter along an axis of the multifrequency antenna.

17. The multifrequency antenna as set forth in claim 16, with the at least two conducting plates having an essentially circular shape.

18. The multifrequency antenna as set forth in claim 16, with the edge-diffraction reflector attached to rear of the multifrequency antenna, including at least five conducting plates.

19. The multifrequency antenna as set forth in claim 16, with the each conducting plate having a circular shape.

20. The multifrequency antenna as set forth in claim 16, with the each conducting plate having any of a square, rectangular, oval, triangular, pentagon, hexagon, or octagon shape.

21. The multifrequency antenna as set forth in claim 15, with the plurality of nonconducting substantially planar substrates, with the conductive layer disposed on the surface of each planar substrate of the plurality of nonconducting substantially planar substrates, including a printed circuit board having a metallic surface on one side.

22. The multifrequency antenna as set forth in claim 15, with the first substrate of the plurality of nonconducting substantially planar substrates, having the first conducting layer including the plurality of slotted openings arrayed about then antenna axis including at least four slotted openings spaced about the antenna axis at ninety degrees.

23. The multifrequency antenna as set forth in claim 22, with the second substrate of the plurality of nonconducting substantially planar substrates, having the second conducting layer including the plurality of slotted openings arrayed about then antenna axis including at least four slotted openings spaced about the antenna axis at ninety degrees.

24. The multifrequency antenna as set forth in claim 15, with the each conductive layer on each of the plurality of nonconducting substantially planar substrates, having a circular shape.

25. The multifrequency antenna as set forth in claim 15, with the each conductive layer on each of the plurality of nonconducting substantially planar substrates, having any of a square, rectangular, oval, triangular, pentagon, hexagon, or octagon shape.

* * * * *